US005286345A

United States Patent [19]

Burt

[11] Patent Number: 5,286,345

[45] Date of Patent: Feb. 15, 1994

[54] PHOTOLITHOGRAPHIC ETCHING PROCESS FOR FABRICATING WIRE SCREEN DISKS FOR CRYOGENIC COOLER REGENERATORS

[75] Inventor: William W. Burt, Hawthorne, Calif.

[73] Assignee: TRW Inc., Redondo Beach, Calif.

[21] Appl. No.: 972,181

[22] Filed: Nov. 3, 1992

[51] Int. Cl.[5] ..... B44C 1/22; C23F 1/00

[52] U.S. Cl. ..... 156/659.1; 156/630; 156/634; 156/644; 156/656; 156/664

[58] Field of Search ..... 156/630, 634, 644, 656, 156/659.1, 664

[56] References Cited

U.S. PATENT DOCUMENTS 3,352,729 11/1967 Kling et al. ..... 156/634

3,614,822 10/1971 Brown ..... 156/630 X

*Primary Examiner*—William A. Powell

*Attorney, Agent, or Firm*—Sol L. Goldstein; James Steinberger

[57] ABSTRACT

A photolithographic etching process for accurately and uniformly fabricating wire screen disks of varying complex geometries for cryogenic cooler regenerators. The photolithographic etching process includes the steps of applying a photoresist to a sheet of wire screen, developing the photoresist in the form of one or more desired disk shapes, and then etching the developed sheet of wire screen to form the wire screen disks. The etching process of the present invention produces wire screen disks with solid edges, thus ensuring that the wire screen disks fit properly in the regenerator. Also, these edges have no loose or bent wires which can break off and potentially damage the compressor and other moving parts of the cryogenic cooler. The etching process of the present invention can be used to fabricate wire screen disks with varying complex geometries, thus allowing for the construction of cryogenic coolers having complex, but more efficient, configurations.

9 Claims, 2 Drawing Sheets

FIG. 1b
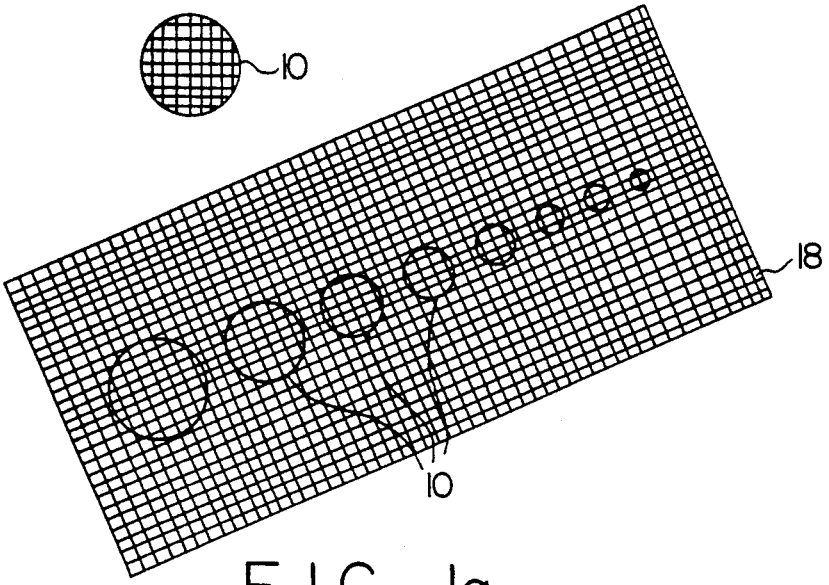
FIG. 1a
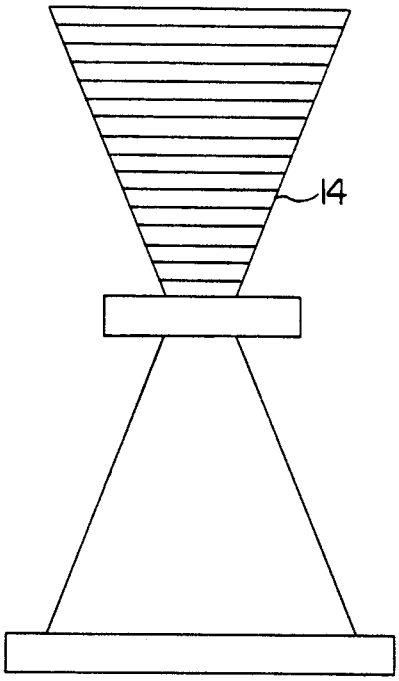
FIG. 2

FIG. 3b
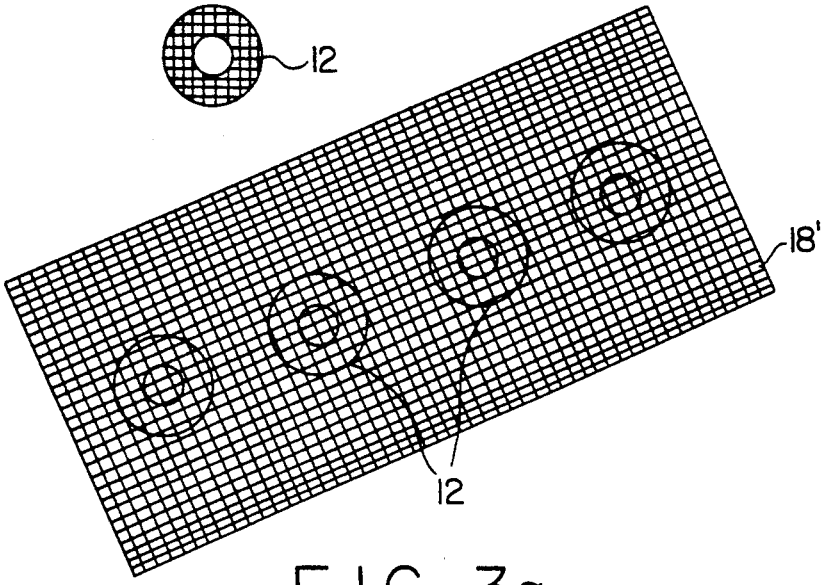
FIG. 3a
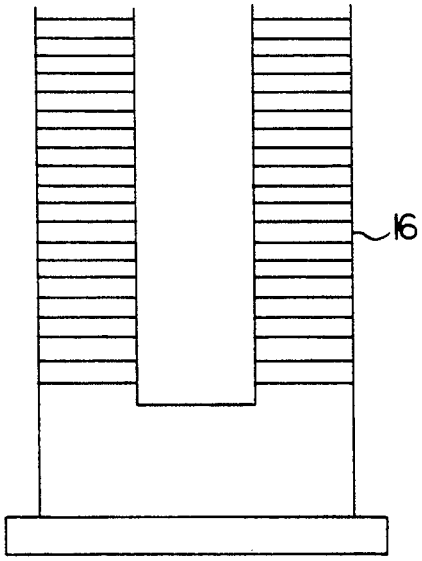
FIG. 4

PHOTOLITHOGRAPHIC ETCHING PROCESS FOR FABRICATING WIRE SCREEN DISKS FOR CRYOGENIC COOLER REGENERATORS

BACKGROUND OF THE INVENTION

This invention relates generally to cryogenic coolers and, more particularly, to methods for fabricating wire screen disks for cryogenic cooler regenerators.

Regenerative cryogenic coolers, such as Stirling and pulsed tube cryogenic coolers, have been developed for cooling space-based infrared detectors to very low temperatures to provide greatly improved infrared detection sensitivities as well as a variety of ground based applications including cryopumps for high vacuum systems. Stirling and pulse tube cryogenic coolers are closed-cycle expansion coolers which produce cooling through an alternating compression and expansion of a gas, such as helium or hydrogen, with a consequent reduction of gas temperature. For example, a typical pulse tube cryogenic cooler utilizes a compressor to generate a continuous pressure wave which produces an alternating mass flow through the pulse tube cooler. The alternating pressure and mass flow is a pressure/-volume work which causes a regenerator to pump heat from a cooling load through a cold end heat exchanger to an aftercooler, where the heat is rejected to a heat sink. Meanwhile, the pressure/volume work travels down the pulse tube, where it is also rejected as heat to the heat sink by a hot end heat exchanger.

The efficiency of a cryogenic cooler, which is largely determined by the efficiency of the regenerator in regenerative type cryogenic coolers, is particularly important in space applications. The regenerator is typically a stack of a thousand or more wire screen disks which act as a thermal sponge, alternately absorbing heat from the gas and then rejecting the absorbed heat to the gas as the pressure wave oscillates back and forth. For good thermal efficiency, the heat transfer between the regenerator and the gas must occur with minimum energy loss. Also, the regenerator must have a large heat capacity compared with that of the gas, as well as have low thermal conductivity along its length to minimize conduction loss. To achieve good thermal efficiency and prevent blow by, as well as provide low thermal conductivity along its length, the wire screen disks must fit properly in the regenerator, preferably with a slip fit.

Wire screen disks are typically fabricated with mechanical punches which are hand or machine driven. However, mechanical punches wear easily and must be frequently sharpened and calibrated. Also, mechanical punches cause frayed edges which prevent the disks from fitting properly in the regenerator. In addition, these frayed edges have loose and bent wires which can break off, potentially causing severe damage to the compressor and other moving parts of the cryogenic cooler. Furthermore, it is difficult to fabricate wire screen disks having complex varying geometries with mechanical punches. Accordingly, there has been a need for an improved method for fabricating wire screen disks for cryogenic cooler regenerators. The present invention clearly fulfills this need.

SUMMARY OF THE INVENTION

The present invention resides in a photolithographic etching process for accurately and uniformly fabricating wire screen disks of varying complex geometries for cryogenic cooler regenerators. The photolithographic etching process includes the steps of applying a photoresist to a sheet of wire screen, developing the photoresist in the form of one or more desired disk shapes, and then etching the developed sheet of wire screen to form the wire screen disks. The etching process of the present invention produces wire screen disks with solid edges, thus ensuring that the wire screen disks fit properly in the regenerator. Also, these edges have no loose or bent wires which can break off and potentially damage the compressor and other moving parts of the cryogenic cooler. The etching process of the present invention can be used to fabricate wire screen disks with varying complex geometries, thus allowing for the construction of cryogenic coolers having complex, but more efficient, configurations.

It will be appreciated from the foregoing that the present invention represents a significant advance in the field of cryogenic coolers. Other features and advantages of the present invention will become apparent from the following more detailed description, taken in conjunction with the accompanying drawings, which illustrate, by way of example, the principles of the invention.

BRIEF DESCRIPTION OF THE DRAWINGS

FIG. 1 is an illustration of a set of circular-shaped wire screen disks having linearly varying diameters which are fabricated with the photolithographic etching process of the present invention;

FIG. 1*b* is an illustration of a disk produced by the photolithographic etching process of FIG. 1*a;*

FIG. 2 is a schematic diagram of a conicalshaped pulse tube cryogenic cooler constructed from the set of circular-shaped wire screen disks;

FIG. 3*a* is an illustration of a set of annular-shaped wire screen disks which are fabricated with the photolithographic etching process of the present invention; and FIG. 3*b* is an illustration of an annular shape disk produced by the process of FIG. 3*a*.

FIG. 4 is a schematic diagram of an annular-shaped pulse tube cryogenic cooler constructed from the set of annular-shaped wire screen disks.

DETAILED DESCRIPTION OF THE PREFERRED EMBODIMENT

As shown in the drawings for purposes of illustration, the present invention is embodied in a photolithographic etching process for accurately and uniformly fabricating wire screen disks of varying complex geometries for cryogenic cooler regenerators. The photolithographic etching process includes the steps of applying a photoresist to a sheet of wire screen, developing the photoresist in the form of one or more desired disk shapes, and then etching the developed sheet of wire screen to form the wire screen disks. The etching process of the present invention produces wire screen disks with solid edges, thus ensuring that the wire screen disks fit properly in the regenerator. Also, these edges have no loose or bent wires which can break off and potentially damage the compressor and other moving parts of the cryogenic cooler. The etching process of the present invention can be used to fabricate wire screen disks with varying complex geometries, thus allowing for the construction of cryogenic coolers having complex, but more efficient, configurations.

As shown In FIGS. 1 and 3, a set of circular-shaped wire screen disks 10 having linearly varying diameters and a set of annular-shaped wire screen disks 12, respectively, are fabricated with the photolithographic etching process of the present invention. The sets of wire screen disks 10, 12 can be used to construct conical-shaped and annular-shaped pulse tube cryogenic coolers 14, 16, as shown in FIGS. 2 and 4, respectively. The conical-shaped pulse tube cryogenic cooler 14 has a conical-shaped regenerator which compensates for the varying thermal properties across the regenerator to improve its efficiency. In a cylindrical-shaped regenerator, the gas densities across the regenerator change dramatically. Therefore, if the cross sectional area of the regenerator also changes, as in the conical-shaped regenerator, the mass flows through the regenerator can be kept essentially constant, thus improving cooler efficiency. The annular-shaped pulse tube cryogenic cooler 16 allows for the construction of a very small, compact pulse tube cryogenic cooler.

As shown in FIGS. 1 and 3, the first step of the photolithographic etching process is to apply a photoresist to a sheet of wire screen 18, 18'. The second step of the etching process is to develop the photoresist in the form of one or more desired disk shapes. FIG. 1 shows a set of circular disk shapes of varying diameters and FIG. 3 shows a set of annular disks shapes. The second step is performed by laying out a photomask on the sheet of wire screen 18, 18', preferably using conventional computer aided design (CAD) techniques. CAD techniques allow incremental step sizes in diameters to be easily performed. The sheet of wire screen 18, 18' is then exposed to light which sensitizes the areas that are to be etched or not etched, depending on whether a negative or positive photoresist is used. The final step of the etching process is to etch the developed sheet of wire screen 18, 18' using conventional acids to form the wire screen disks 10, 12.

The circular-shaped wire screen disks 10 have diameters on the order of ¼" to 1" and the annularshaped wire screen disks 12 have outside diameters up to 2" and inside diameters up to 1". The wire screen is preferably fabricated from metal wire having a thickness on the order of 0.010" to 0.030". The porosity of the wire screen is on the order of 60%. Readily available wire screens include stainless steel, phosphor bronze, copper and aluminum wire screens.

Although the photolithographic etching process of the present invention has been described for fabricating wire screen disks for pulse tube regenerators, the etching process of the present invention is suitable for fabricating wire screen disks for all types of closed-cycle expansion cryogenic coolers, as well as for all other types of cryogenic coolers.

From the foregoing, it will be appreciated that the present invention represents a significant advance in the field of cryogenic coolers. Although a preferred embodiment of the invention has been shown and described, it will be apparent that other adaptations and modifications can be made without departing from the spirit and scope of the invention. Accordingly, the invention is not to be limited, except as by the following claims.

I claim:

1. A photolithographic etching process for fabricating wire screen disks for cryogenic cooler regenerators, comprising the steps of:

applying a photoresist to a sheet of wire screen;

developing the photoresist in the form of one or more desired disk shapes; and etching the developed sheet of wire screen to form the wire screen disks.

2. The fabrication method as set forth in claim 1, wherein the wire screen disks are circularshaped disks having linearly varying diameters.

3. The fabrication method as set forth in claim 1, wherein the wire screen disks are annularshaped disks.

4. A method for fabricating wire screen disks for cryogenic coolers, comprising the step of:

photolithographically etching a sheet of wire screen to form one or more wire screen disks.

5. The fabrication method as set forth in claim 4, wherein the wire screen disks are circularshaped disks having linearly varying diameters.

6. The fabrication method as set forth in claim 4, wherein the wire screen disks are annularshaped disks.

7. A method for fabricating screen disks for cryogenic coolers, comprising the step of: lithographically etching a sheet of screen to form one or more screen disks.

8. The fabrication method as set forth in claim 7, wherein the screen disks are circular-shaped disks having linearly varying diameters.

9. The fabrication method as set forth in claim 7, wherein the screen disks are annular-shaped disks.

* * * * *